US010100587B2

(12) United States Patent
McLaughlin

(10) Patent No.: US 10,100,587 B2
(45) Date of Patent: Oct. 16, 2018

(54) HYDRAULIC-MECHANICAL PIPE CONNECTOR FOR TOOL CONNECTION AND PIPE SPLICING

(71) Applicant: Stuart McLaughlin, Magnolia, TX (US)

(72) Inventor: Stuart McLaughlin, Magnolia, TX (US)

( * ) Notice: Subject to any disclaimer, the term of this patent is extended or adjusted under 35 U.S.C. 154(b) by 37 days.

(21) Appl. No.: 15/370,553

(22) Filed: Dec. 6, 2016

(65) Prior Publication Data

US 2017/0198532 A1 Jul. 13, 2017

Related U.S. Application Data

(60) Provisional application No. 62/238,090, filed on Oct. 6, 2015.

(51) Int. Cl.

| | |
|---|---|
| ***E21B 17/02*** | (2006.01) |
| ***E21B 17/06*** | (2006.01) |
| ***E21B 31/18*** | (2006.01) |

(52) U.S. Cl.

CPC ..... *E21B 17/06* (2013.01); *E21B 17/02* (2013.01); *E21B 31/18* (2013.01)

(58) Field of Classification Search

CPC .... E21B 17/02; E21B 19/163; E21B 33/0422; E21B 17/06; E21B 31/18

See application file for complete search history.

(56) References Cited

U.S. PATENT DOCUMENTS

| | | | | |
|---|---|---|---|---|
| 7,455,105 | B1 * | 11/2008 | McKee | E21B 17/20 166/77.2 |
| 2009/0178810 | A1 * | 7/2009 | Cenac | E21B 31/18 166/387 |
| 2017/0314338 | A1 * | 11/2017 | Barton | E21B 17/06 |

* cited by examiner

*Primary Examiner* — Cathleen R Hutchins

(74) *Attorney, Agent, or Firm* — Kearney, McWilliams & Davis, PLLC; William C. Yarbrough, III

(57) ABSTRACT

The present invention provides a device, namely a hydraulic-mechanical pipe connector that allows a simple, user friendly way to attach pipe and tools to one another whether this is a single connection to a bottom hole assembly or a splice connection joining two pipe ends together, thereby eliminating the need for tools such as wrenches and tongs and removing the need and difficulty of requiring pipe rotation to make up the connection. It also provides a simple, safe and efficient manner to affix a tool, sub assembly, bottom hole assembly or similar oil tools to the end of a pipe that has no thread attachment, without the need for the hand tools and wrenches. More importantly, the present invention provides a device that can splice multiple pipe or coil sizes together using the hydraulic actuation technique.

15 Claims, 4 Drawing Sheets

HYDRAULIC-MECHANICAL PIPE CONNECTOR FOR TOOL CONNECTION AND PIPE SPLICING

CROSS-REFERENCE TO RELATED APPLICATION

This non-provisional application claims benefit of the provisional application U.S. Ser. No. 62/238,090 filed on Oct. 6, 2015.

BACKGROUND OF THE INVENTION

Field of the Invention

The present invention generally relates to a device that can be used to connect tools to a pipe or coil tubing or connect at least one pipe or at least one coiled tubing. Specifically, the present invention relates to a device such as a hydraulic-mechanical pipe connector that allows attachment of two pipe ends or two non-threaded pipe ends and splicing of multiple pipes or coiled tubings together using a hydraulic actuation technique.

BACKGROUND

The use of slip or grapple type connectors for attaching tools to pipe, coil tubing, non-threaded end connections, bare pipe end/s and pipe to pipe end splicing has been around for decades and the design of the connector has changed very little since its first use. A typical slip type connector, a common term in the oil and gas industry, is comprised of a top and bottom sub and a housing that contains an upper and lower cone of various types and a set of slips that have grooves of various shapes and forms that are used to grip the pipe. The slips are made to grip the pipe by means of the upper, lower or both upper and lower subs turned manually to force the cones onto the slips thereby pushing the slips onto the pipe and causing them to grip the pipe's outside diameter.

The manual makeup of the slip or grapple type connector can be accomplished by various ways but for the most part involves the use of pipe wrenches or tongs to secure the connection to the pipe and then some form of full or partial rotation to activate the slips to grip the pipe. This process is time consuming and often results in a non-approved attachment. When the slips are not set correctly onto the pipe, the connector is generally cut from the pipe and a new slip connector is attached in the same fashion. There are no slip or grapple connectors today that provide ease of removal from the pipe.

Further, to slide the connector onto the pipe takes force in part because the internal diameter of the slips are approximately the same as or within close tolerance to that of the outside diameter of the pipes and, as a result of this, the slips tend to rub against the pipe and cause binding. This binding in many instances requires the force of the pipe or coil to be applied downward into the slip connector to ensure the pipe enters the slip connector all the way to bottom. In most cases a protective plate or cap is affixed to the end of the slip connector to prevent damage to the end. In many cases the pipe is oval due to constant use and makes for an extremely difficult attachment process. All of this involves additional time to make up, difficulty in the attachment process, use of wrenches, tongs or some form of manual hand tools, and is of a safety concern to all personnel during the process. Similarly, the ability to splice pipe together without the use of threaded ends or couplings has proven to be difficult due to the need for pipe or connection rotation and the need for tongs or hand tools such as pipe wrenches to secure the pipe to pipe ends onto a coupling or mid joint connector of various designs and descriptions.

Thus, there is a long-felt but significant and un-met need in the art for a pipe connector that uses hydraulic pressure to provide a simple, safe and efficient means to affix a tool, a sub assembly, bottom hole assembly or similar oil tools to the end of a pipe that has with or without thread attachment. Additionally, there is a long-felt but significant and un-met need in the art for a pipe connector that uses hydraulic pressure to splice multiple pipe or coil sizes together. The present invention satisfies this long-standing need in the art.

SUMMARY OF EMBODIMENTS OF THE INVENTION

In a preferred embodiment, the present invention is directed to a device, comprising: an Assembly comprising a top sub, upper cone, fishing neck, or a combination thereof; at least one pair of set screws, the set screws installed in the assembly; a main housing; a lower cone, the lower cone installed in the main housing; slips to hold a pipe or a coiled tubing, the slips installed in the main housing; at least one pair of expansion springs, wherein the expansion springs are installed in the slips and allows the slips to retract away from the pipe when the assembly is in an unset position; a lower piston housing; at least one pair of internal O-rings, the internal O-rings installed in the lower piston housing and wherein the internal O-rings provide a sealing barrier between the inside of the pipe and the outside of the device; a piston body lock ring assembly; said piston body lock ring assembly comprising a piston, at least one pair of piston O-rings and a body lock ring, wherein the body lock ring is placed on trailing end of the piston and locks the piston in place, wherein the piston O-rings provide a hydraulic piston force to move the piston and the lower cone; a port installed in the lower piston housing to connect a hydraulic line; or a combination thereof.

In another embodiment, the Assembly comprising the top sub, upper cone and fishing neck can be removed and attached to the lower piston housing and wherein the lower piston housing can be removed and attached to the assembly without any special tools.

In yet another embodiment, the application of hydraulic pressure energizes the lower cone and the upper cone to secure the slips onto the pipe or the coiled tubing.

In further yet another embodiment, the trailing piston lock ring has no external force applied to it post-activation.

In still yet another embodiment, the slips have an internal diameter larger than the outside diameter of the pipe to prevent friction.

In another embodiment, in the absence of the set screws the port permits access of wellbore fluid and pressure to maintain and energize the piston body lock ring assembly and the cones to secure the slips further onto the outside diameter of the pipe.

In yet another embodiment, the device can be redressed in the field.

In still yet another embodiment, the top sub comprises multi start thread that allows unscrewing the top sub and moving the upper cone away from the slips, thereby allowing the slips to retract away from the pipe and releasing the pipe, without the need to cut the pipe to release the device.

In further yet another embodiment, the device can attach hydraulically to varying sizes of pipe or coiled tubing together without the need for complex splice subs or pipe rotation.

In still yet another embodiment, the device connects tools to a pipe or a coiled tubing.

In another embodiment, the device forms a splice connection for a pipe or a coiled tubing.

In yet another embodiment, the splice connection for a pipe comprises: at least two of said devices attached together end to end with one of the devices facing downwards and the other device facing upwards, wherein each of the device is used to attach at least one pipe.

In further yet another embodiment, the splice connection for a coiled tubing, comprises: at least two of said devices attached together end to end with one of the devices facing downwards and the other device facing upwards, wherein one of the device is used attach to the coil on a reel and the other device is used to attach a lower length of a coil that is suspended in the well.

In another preferred embodiment, the present invention is directed to a method of connecting tools to a pipe or a coil tubing, comprising: pushing the device described supra up on to end of the pipe or coiled tubing until the pipe's or coiled tubing's "No-Gos" is inside the device; connecting a hydraulic hose to the Port on the side of the device, the port permits access to hydraulic pressure or well-bore fluid and hydraulic pressure, wherein the pressure energizes the upper and lower cones; locking the slips onto the pipe or the coiled tubing; detaching the hydraulic hose from the port, wherein the pipe or the coiled tubing remains attached to the device after detaching the hydraulic hose; and attaching tools to the attached pipe or the attached coil tubing.

In yet another preferred embodiment, the present invention is directed to a method of forming a splice connection for a tube or a coiled tubing, comprising: attaching at least two devices described supra together end to end, the one device facing downward and the second device facing upwards; pushing the upward facing device and the downward facing device on to ends of at least one pipe or coiled tubing until the pipe's or coiled tubing's "No-Gos" is inside either the upward facing device or the downward facing device; connecting a hydraulic hose to the port on the side of the device, the port permits access to hydraulic pressure or well-bore fluid and hydraulic pressure, wherein the pressure energizes the upper and lower cones; locking the slips onto the pipe or the coiled tubing; detaching the hydraulic hose from the port, wherein the pipe or the coiled tubing remains attached to either the upward facing device or the downward facing device after detaching the hydraulic hose.

DETAILED DESCRIPTION

The present invention provides a device, namely, a hydraulic-mechanical pipe connector that eliminates the use of rotational parts to attach to the pipe or coil and does not require the use of hand tools to make up any threaded portion of the assembly to the pipe or coil. The invention eliminates the need for the internal diameter of the slips to be the same as or within close tolerance to that of the outside diameter of the pipe as the slips are designed to be held away from the pipe's outside diameter to allow for an easy, non-friction, and non-contact attachment.

Figure 1:
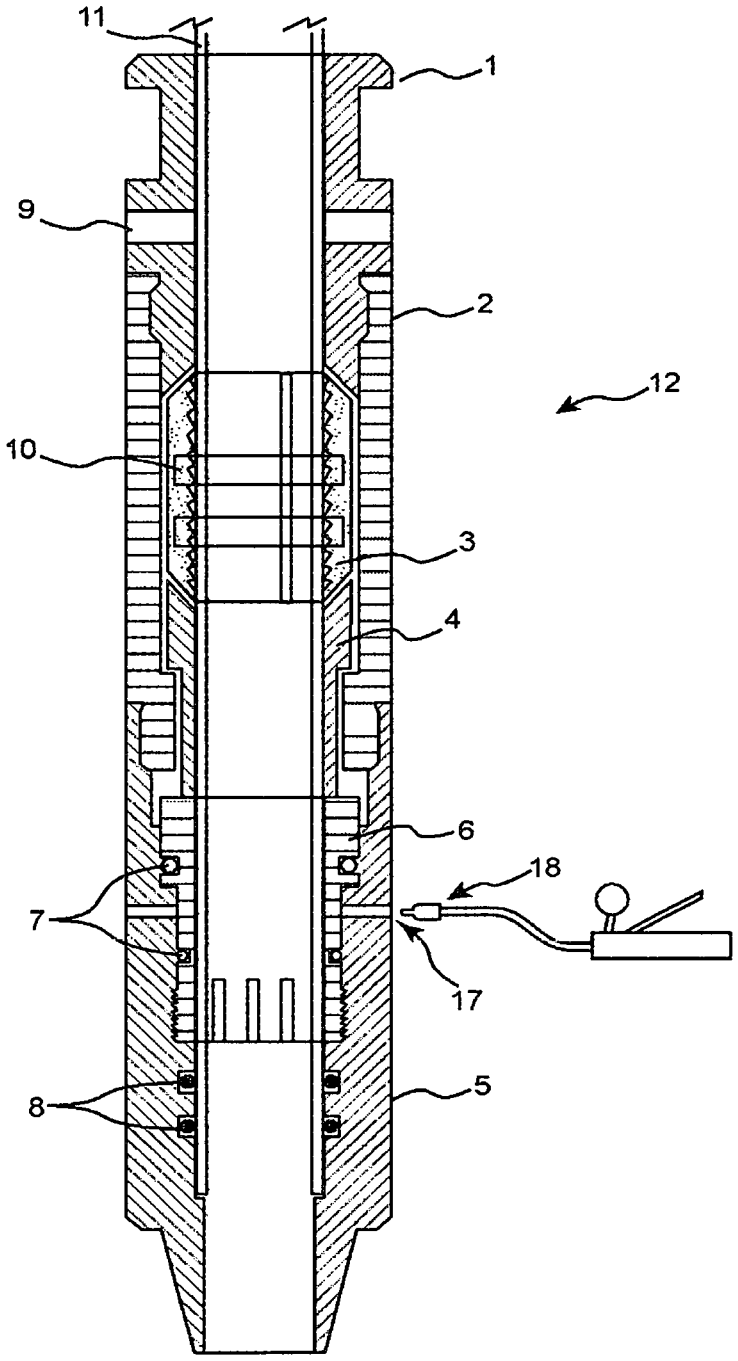
FIG. 1 shows the cross-sectional side view of the hydraulic-mechanical pipe connector.
Figure 2:
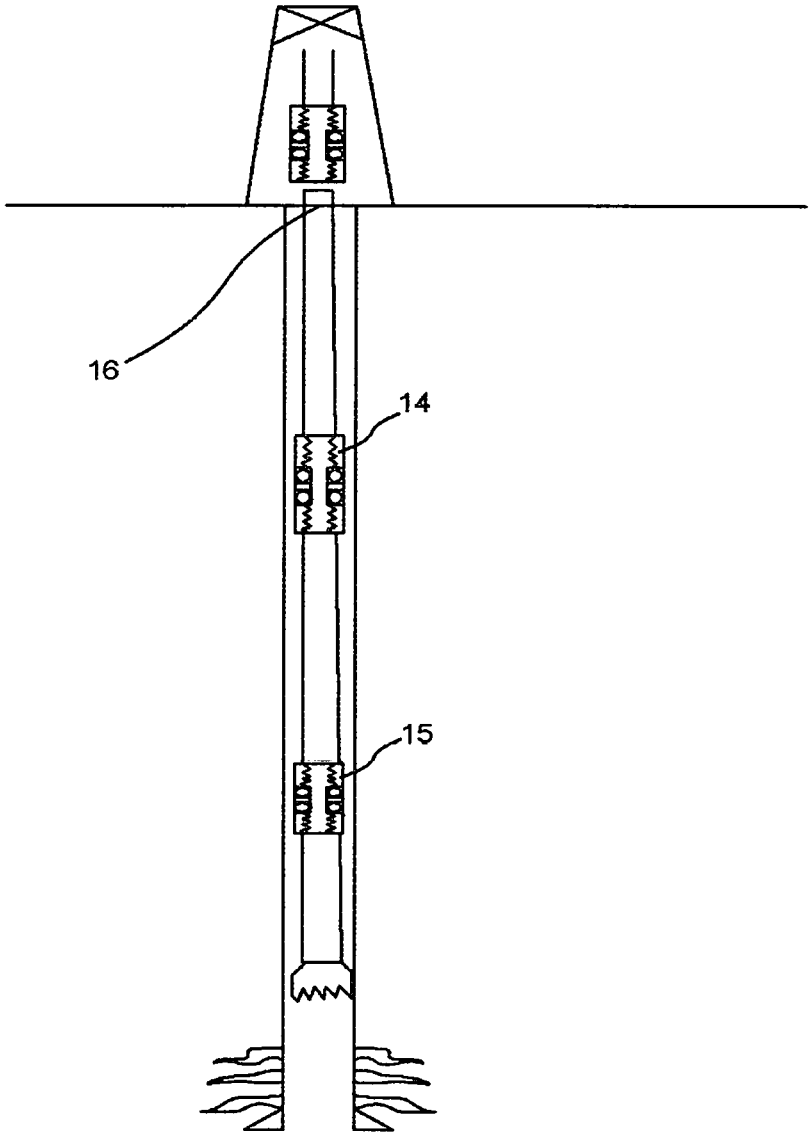
FIG. 2 shows the typical rig and well bore comprising port (#17), non-threaded end (#16) of pipe (#11), a previously performed pipe splice (#14) and a hydraulic-mechanical pipe connector attached (#15) to the bottom hole assembly.

The device described herein attaches to the pipe or coiled tubing using hydraulic pressure supplied via a temporary hydraulic line affixed during the make-up process and easily removed once the slips are set. The hydraulic piston activates the cones that sets the slips and is secured in place by an embedded body lock ring that prevents the piston's movement in the downward or upward position depending on the location of the piston, which can be placed above or below the slips. The lock ring can be embedded or be a separate part of the activation mechanism and can be in various forms and designs that are known in the art.

in a preferred embodiment, the hydraulic-mechanical pipe connector #12 (FIG. 1), comprises a top sub, upper cone and fishing neck assembly (#1), a main housing (#2), slips (#3), a lower cone (#4), a lower piston housing (#5), a piston body lock ring assembly (#6), piston o rings (#7), internal o rings (#8), set screws (#9), and expansion rings (#10). the piston body lock ring assembly (#6) further comprises a piston, O-rings and body lock ring all manufactured into one piece. in an alternate embodiment, the assembly comprising the top sub, upper cone and fishing neck may comprise only the top sub and the upper cone. a hydraulic activation port (#17) as shown in FIG. 2 is either (1) plugged off to ensure cleanliness of the piston area, (2) plugged using a filter combination set screw to allow wellbore hydraulic pressure to maintain pressure on the piston thereby ensuring a constant force is applied to the cones and slips or (3) left open with no isolation/filter set screw.

The top sub, upper cone and fishing neck assembly (#1) is manufactured with a set of screw holes that are used to provide for additional anchoring of the hydraulic-mechanical pipe connector (#12) in the tension, compression and torque axes. The top sub can be manufactured with a fishing neck for recovery of the assembly from the well should the connector be left in the hole or alternately with a tapered top sub. The piston body lock ring assembly (#6) that is used for activating the cones and energizing the slips has a modular design and can be interchanged between upper hydraulic-mechanical pipe connector assemblies. This modular design allows for either the upper slip assembly or the lower piston assembly to be interchanged with other parts in the event of a failure without the need to repair the entire assembly.

The hydraulic-mechanical pipe connector can be easily removed from the pipe by rotating the top sub in the top sub, upper cone and fishing neck assembly (#1) that incorporates a multi start thread to speed up the process of removal. By unscrewing the top sub, the upper cone in this assembly (#1) is moved away from the slip (#3) allowing the slip (#3) to retract away from the pipe (#11) and release the hydraulic-mechanical pipe connector (#12) from the coil quickly and safely without the need to cut the coil or pipe. The top sub (#1) can then be screwed back in place to the set position. The piston body lock ring assembly (#6) can then be removed and the embedded lock ring in the piston body lock ring assembly (#6) can be reset to the set or start position. By doing this, the hydraulic-mechanical pipe connector (#12) is now ready to reattach to the pipe in minutes.

A pipe to pipe attachment feature is available whereby using two identical devices attached together, the hydraulic-mechanical pipe connector (#12) can then be used to attach an upper pipe and a lower pipe to create a simple and effective splice connection or in the case of coil tubing the coil on the reel and a lower length of coil (possibly suspended in the well) can be spliced together without the need for the afore-mentioned tools (wrenches, tongs, etc.). The entire hydraulic-mechanical pipe connector (#12) is capable of being field redressed in minutes unlike current systems that are generally sent back to the supplier for shop redress.

Relationship Between the Components:

The hydraulic-mechanical pipe connector (#12) comprises several components described earlier that together as an assembly attaches to the pipe (#11). Individually each component operates as follows:

The top sub, upper cone and fishing neck assembly (#1) is screwed onto the main housing (#2) using a multi lead thread. One or more of the expansion springs (#10) are inserted into the Slips (#3) to allow the slips (#3) to retract away from the pipe when the assembly is in the unset position. The lower cone (#4) is mounted inside main housing (#2) to energize the slips (#3) once the hydraulic activation process has started. The O-rings (#8) are pre-installed inside the lower piston housing (#5) to provide a sealing barrier between the inside of the pipe (#11) and the outside of the hydraulic-mechanical pipe connector (#12). The O-rings (#7) is pre-installed inside the piston body lock ring assembly (#6) to provide a hydraulic piston force to move the piston and lower cone (#4). The set screws (#9) are pre-installed inside top sub, upper cone and fishing neck assembly (#1) to provide additional locking force in the tension, compression and torque axis.

How the Invention Works:

In another preferred embodiment, the method to affix the hydraulic-mechanical pipe connector (#12) to the pipe (#11) comprises: sliding the hydraulic-mechanical pipe connector (#12) onto the end of the pipe (#11) until the pipe's (#11) "No-Go" is inside the lower piston housing (#5); attaching a hydraulic line (#18) to the port (#17); and applying the required hydraulic pressure to the hydraulic-mechanical pipe connector (#12) via the port item #17, which is machined into the lower piston housing (#5) and the piston body lock ring assembly (#6) and O-rings (#7) to activate the piston body lock ring assembly (#6), which will move upward (or downward depending on design set-up) and will move the lower cone (#4) that will in-turn push the slips (#3) onto the pipe (#11). The slips (#3) will be pushed against the top sub, upper cone and fishing neck assembly (#1) resulting in an even and linear movement of the slips (#3) onto the pipe (#11). As the piston body lock ring assembly (#6) moves, the body lock ring section of this assembly will ratchet forward preventing the entire piston body lock ring assembly (#6) from returning to the 'set' position. Once the hydraulic 'set' pressure limit has been reached the pressure can be bled off and the hydraulic hose removed from the port (#17). A solid or filtered set screw can be installed into the port (#17), if required, to isolate from debris ingress into the device from wellbore fluids and particulate.

Figure 1A:
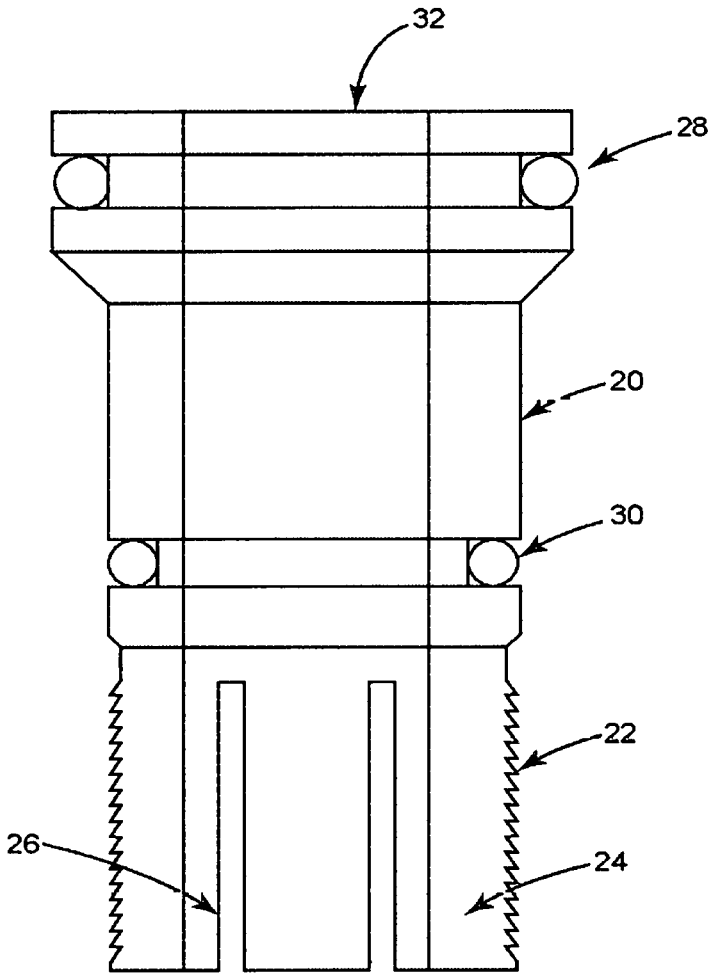
FIG. 1*a* shows the cross-sectional side view of a detailed description of the piston body lock ring assembly.

More specifically FIG. 1*a* shows a view of the body lock ring piston assembly (#6) that provides both the hydraulic pressure to activate the travel of the piston into the slips (#3) and also activates the ratchet/wicker thread fingers (#22) that prevent the piston body (#20), once pressure is bled off, from returning to it previous position. The body lock ring (#24) and piston body (#20) provide the force and locking mechanism to anchor the slips (#3) onto the pipe end using hydraulic pressure applied between the primary O-ring (#28) and secondary O-ring (#30). As the piston body (#20) moves towards the slips (#3) with the application of hydraulic pressure between the O-rings (#28) and (#30) the body lock ring fingers (#24) travel along the piston bore whereby the wicker thread (#22) collapses inward to allow forward movement of the body lock ring piston assembly (#6). As the body lock ring piston assembly (#6) shown in FIG. 1A moves forward, the wicker thread (#22) activates inward and outward to move and lock the body lock ring piston assembly (#6) as it travels. Once the body lock ring fingers (#24) and body lock ring piston assembly (#6) have reach their final set point, hydraulic pressure is bled off between the O-rings (#28) and (#30) and the wicker thread (#22) and body lock ring fingers (#24) lock outward and into their mating part within the body lock ring piston assembly (#6). The shape of the wicker threads (#22) eliminates the possibility of the body lock ring piston assembly (#6) from retracting to its original position thereby locking the body lock ring piston assembly (#6) in place and engaging the slips (#3) in such a manner that the slips (#3) cannot release their grip from the pipe end. Finally, the through bore (#32) permits the passage of the pip end through the entire body lock ring piston assembly (#6).

In an alternate preferred embodiment, no set screw is required to be installed. Where a filtered or no set screw approach is taken, wellbore fluids and pressure will enter the port and continue to energize the piston body lock ring assembly (#6) that will result in a positive force on the lower cone (#4), the top sub, upper cone and fishing neck assembly (#1) and the slips (#3). this will result in a continuous and secure anchoring of the hydraulic-mechanical pipe connector (#12) to the Pipe (#11) as shown in FIG. 1.

In another preferred embodiment, the hydraulic-mechanical pipe connector (#12) is released from the Pipe (#11) by simply rotating the top sub, upper cone and fishing neck assembly item #1 in an anti-clockwise direction to release the slips (#3) from the upper cone (#1) & lower cone (#4).

In yet another preferred embodiment, the piston body lock ring assembly (#6) is reset by unscrewing the main housing (#2) from the lower piston housing (#5). the piston body lock ring assembly (#6) is rotated in an anti-clockwise direction until it returns to the 'set' position and then re-attached the lower piston housing (#5) to the end of the main housing (#4). The assembly is now ready to re-use.

In further yet another embodiment, the method to makeup a splice connection between two independent pieces of pipe (#11) comprises attaching the end of one hydraulic-mechanical pipe connector (#12) to end of a second hydraulic-mechanical pipe connector (#12) and make-up the pipe #11 into each end of the hydraulic-mechanical pipe connectors (#12).

The hydraulic-mechanical pipe connector (#12) described herein and the components associated with it can be manufactured using any materials known in the art including but not limited to plastic, steel, aluminum alloy, steel alloy or similar material. hydraulic-mechanical pipe connector (#12) and the components associated with it can be manufactured to have any suitable shape, size or dimension as needed or desired.

The hydraulic-mechanical pipe connector (#12) can be manufactured using any process that is known in the art including but not limited to "the machining process." As used herein, the term "the machining process" comprises any of the processes used to cut a raw material into a desired shape and size by machine tools. For instance, the machining process involved herein may include but is not limited to turning or lathe work to manufacture the profiles on the inner and outer diameters of the individual parts provided on the manufacturing drawings. It may also include but is not limited to milling operations to manufacture any side ports on the housing and thread work to provide connections. Once the Slip sections are machined they are sent to be heat treated per design specifications. Third party parts such as O-rings and set screws are purchased and all the parts of the hydraulic-mechanical pipe connector (#12), where necessary will be sent to third party companies for coatings etc.

How to Use the Invention:

In a preferred embodiment, the invention is used to attach various components together in a string or more commonly known word a 'Bottom Hole Assembly' (BHA). The BHA in its entirety is to be attached to the end of the pipe or coil. In case of coil tubing, there is no threaded connection on the end of the pipe itself and therefore, the hydraulic-mechanical pipe connector (#12) is employed to connect to the end of the coiled tubing.

The hydraulic-mechanical pipe connector (#12) makes this function superior in attachment in terms of speed, simplification and safety. The hydraulic-mechanical pipe connector (#12) is simply pushed up on to the end of the pipe (#11) or coiled tubing with ease due to the fact the Slips (#3) have been designed to not contact the pipe's outside diameter and cause friction. Once the pipe's (#11) "No-Go" is inside the hydraulic-mechanical pipe connector (#12), pressure is applied through a separate hydraulic hose to the port (#17) on the side of the hydraulic-mechanical pipe connector (#12) and the pressure energizes the internal cones (#1 and #4) via a piston and locks the slips (#3) onto the pipe (#11) securely. A piston stop point is designed into the piston travel to prevent excessive force damaging the coil or pipe (#11) and potentially deforming or collapsing the coil or pipe (#11). Once attached securely, the external hydraulic hose is released and the rest of the bottom hole assembly is ready to attach to the end of the hydraulic-mechanical pipe connector (#12) prior to deployment into the wellbore.

Figure 3:
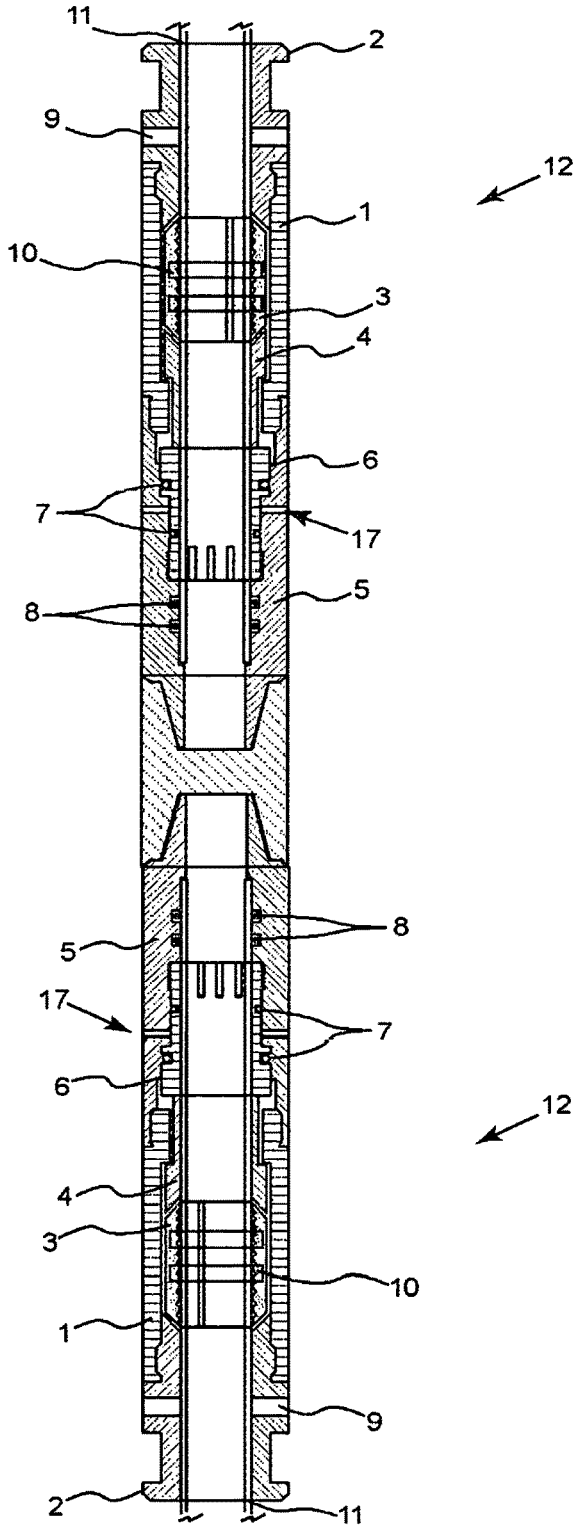
FIG. 3 shows the pipe splice assembly comprising at least one hydraulic-mechanical pipe connector facing downward and at least one hydraulic-mechanical pipe connector facing upward.

In another preferred embodiment, to makeup a pipe splice (#14), one end of one of the hydraulic-mechanical pipe connector (#12) is attached to the end of another hydraulic-mechanical pipe connector (#12) such that one of the hydraulic-mechanical pipe connector (#12) faces up and the other hydraulic-mechanical pipe connector (#12) faces downward shown in FIG. 3. The hydraulic-mechanical pipe connector (#12) is attached to the upper non-threaded end (#16) of the pipe (#11) and secured hydraulically as previously discussed. The opposite end of this pipe (#11) is then attached to the lower end of another hydraulic-mechanical pipe connector (#12) as shown in FIG. 1/splice (#14), thereby joining both upper and lower pipe ends together without the need for any pipe rotation. This process can be performed in the reverse order, for instance, by attaching the lower end of the Pipe (#11) to one hydraulic-mechanical pipe connector (#12) shown in FIG. 1/splice (#14) and then attaching the upper non-threaded end (#16) of the pipe (#11) to the other hydraulic-mechanical pipe connector (#12). FIG. 2 shows a previously performed pipe splice (#14) and a single hydraulic-mechanical pipe connection (#15) attached to the bottom hole assembly.

As used herein, the term "top sub, upper cone and fishing neck" refer to the means mounted atop the main housing #2 and provides a way for the Slips #3 to be drawn inward towards the pipe and create a clamping force via the cones (#1 and #4). Additionally, it also serves as a means to recover the hydraulic-mechanical pipe connector (#12) should it be lost downhole via the external fishing neck.

As used herein, the term "main housing refers to the main body of the device that houses the slips (#3) and the expansion springs (#10) that assist in the release of and push outward the slips (#3) away from the pipe (#11). the main housing (#2) also houses the lower cone (#4) that is used to draw inward the slips (#3) to the pipe (#11) and creates a clamping force via the piston body lock ring assembly (#6) pushing force acting on the lower end of the lower cone (#4).

As used herein, the term "slips" refers to means in the hydraulic-mechanical pipe connector (#12) to grip the pipe's outside diameter and hold it in place.

As used herein, the term "lower cone" refers to means mounted in the main housing of the hydraulic-mechanical pipe connector (#12) that energizes the slips once the hydraulic activation process has started.

As used herein, the term "lower piston housing" refers to the portion of the tool that houses the piston body lock ring assembly (#6) that is used to force the lower cone (#4) into the slips (#3) to the pipe (#11). The piston body lock ring assembly (#6) also has the body lock ring feature included in this component that prevents the piston body lock ring assembly (#6) from unlocking or moving away from the lower cone (#4) once the pressure has been removed after the hydraulic setting sequence is complete. The lower piston housing has internal O-rings (#8) that seal between the lower piston housing (#5) and the end of the pipe (#11) to create a seal path between the two items.

As used herein, the term "piston body lock ring assembly" refers to the primary activation and setting method and primary locking method by which the hydraulic-mechanical pipe connector (#12) is attached to the pipe (#11) and held in place. This also prevents the hydraulic-mechanical pipe connector (#12) from releasing from the pipe (#11) once the hydraulic pressure is removed after the setting sequence is complete. The piston body lock ring assembly (#6) comprises a shoulder to push against the slips (#3), piston O-rings (#7) to energize via hydraulic port (#17) that moves the piston towards the slips (#3) and forces them onto the pipe (#11). It also comprises the body lock ring feature within the piston body lock ring assembly (#6) that locks the assembly of the hydraulic-mechanical pipe connector (#12) with the pipe (#11) and prevents this assembly from disconnecting once the pressure is released.

As used herein, the term "piston O-rings" refers to means installed in the piston body lock ring assembly to provide a hydraulic piston force to move the piston and the lower cone.

As used herein, the term "internal O-ring seals" refers to means to provide a sealing barrier between the inside of the pipe and the outside of the hydraulic-mechanical pipe connector (#12).

As used herein, the term "set screws" refers to means that are installed in the top sub, upper cone, and fishing neck assembly to provide additional locking fore in the tension, compression and torque axis.

As used herein, the term "expansion springs" refers to means in the hydraulic-mechanical pipe connector (#12) that allows the slips (#3) to retract away from the pipe when the hydraulic-mechanical pipe connector assembly is in an unset position.

As used herein, the term "port (#17)" refers to an opening or an aperture to which a hydraulic line (#18) is attached or connected to provide hydraulic pressure to activate the slips via a pump, hand pump or a similar fluid reservoir.

The foregoing descriptions of the embodiments of the present invention have been presented for purposes of illustration and description. They are not intended to be exhaustive or to limit the present invention to the precise forms disclosed. The exemplary embodiments were chosen and described in order to best explain the principles of the present invention and its practical application, to thereby enable others skilled in the art to best utilize the present invention.

What is claimed is:

1. A device, comprising:

an Assembly comprising a top sub, upper cone, fishing neck, or a combination thereof;

at least one pair of set screws, said set screws installed in the Assembly;

a main housing;

a lower cone, said lower cone installed in the main housing;

slips to hold a pipe or a coiled tubing, said slips installed in the main housing;

at least one pair of expansion springs, wherein said expansion springs are installed in the slips and allows the slips to retract away from the pipe when the assembly is in an unset position;

a lower piston housing;

at least one pair of Internal O-rings, said Internal O-rings installed in the lower piston housing and wherein said Internal O-rings provide a sealing barrier between the inside of the pipe and the outside of the device;

a piston body lock ring; said piston body lock ring assembly comprising a piston, at least one pair of piston O-ring and a body lock ring, wherein the body lock ring is placed on trailing end of the piston and locks the piston in place, wherein the piston O-rings provide a hydraulic piston force to move the piston and the lower cone;

a Port installed in the lower piston housing to connect a hydraulic line.

2. The device of claim 1, wherein the assembly comprising the top sub, upper cone and fishing neck can be removed and attached to the lower piston housing, and wherein the lower piston housing can be removed and attached to the assembly comprising the top sub, upper cone and fishing neck via pressure actuation.

3. The device of claim 1, wherein application of hydraulic pressure energizes the lower cone and the upper cone to secure the slips onto the pipe or the coiled tubing.

4. The device of claim 1, wherein said trailing piston lock ring has no external force applied to the piston lock ring post-activation.

5. The device of claim 1, wherein said slips have an internal diameter larger than the outside diameter of the pipe to prevent friction.

6. The device of claim 1, wherein, in the absence of the set screws, said port permits access of wellbore fluid and pressure to maintain and energize the piston body lock ring assembly and the cones to secure the slips further onto the outside diameter of the pipe.

7. The device of claim 1, wherein said device can be redressed in the field.

8. The device of claim 1, wherein the top sub comprises multi start thread that allows unscrewing the top sub and moving the upper cone away from the slips, thereby allowing the slips to retract away from the pipe and releasing the pipe, without the need to cut the pipe to release the device.

9. The device of claim 1, wherein the device can attach hydraulically to varying sizes of pipe or coiled tubing together.

10. The device of claim 1, wherein said device connects tools to the pipe or the coiled tubing.

11. The device of claim 1, wherein said device forms a splice connection for a pipe or a coiled tubing.

12. The device of claim 11, wherein said splice connection for a pipe comprises:

attaching at least two of said devices together end to end with one of said devices facing downwards and the other device facing upwards, wherein each of said device is used to attach at least one pipe.

13. The device of claim 11, wherein the splice connection for said coil tubing, comprises:

at least two of said devices attached together end to end with one of said devices facing downwards and the other device facing upwards, wherein one of said device is used attach to the coil on a reel and the other device is used to attach a lower length of a coil that is suspended in a well.

14. A method of connecting tools to a pipe or a coil tubing, comprising:

pushing the device of claim 1 up on to the end of the pipe or coiled tubing until the pipe's or coiled tubing's No-Gos is inside the device;

connecting a hydraulic hose to the port on the side of the device, said port permitting access to hydraulic pressure or well-bore fluid and hydraulic pressure, wherein said pressure energizes the upper and lower cones;

locking the slips onto the pipe or the coiled tubing;

detaching the hydraulic hose from the port, wherein said pipe or said coiled tubing remains attached to the device after detaching the hydraulic hose; and attaching tools to said attached pipe or said attached coil tubing.

15. A method of forming a splice connection for a tube or a coiled tubing, comprising:

attaching at least two devices of claim 1 together end to end, said first device facing downward and said second device facing upwards;

pushing said upward facing device and said downward facing device onto ends of at least one pipe or a coiled tubing until the pipe's or coiled tubing's No-Gos is inside either the upward facing device or the downward facing device;

connecting a hydraulic hose to the port on the side of the device, said port permits access to hydraulic pressure or well-bore fluid and hydraulic pressure, wherein said pressure energizes the upper and lower cones;

locking the slips onto said pipe or said coiled tubing;

detaching the hydraulic hose from the port, wherein said pipe or said coiled tubing remains attached to either the upward facing device or the downward facing device after detaching the hydraulic hose.

* * * * *